United States Patent [19]

Kidd

[11] 4,175,476

[45] Nov. 27, 1979

[54] METHOD AND APPARATUS FOR FORMING REINFORCED TOP FILE FOLDERS

[75] Inventor: Arthur H. Kidd, Menomonee Falls, Wis.

[73] Assignee: H. G. Weber & Co., Inc., Kiel, Wis.

[21] Appl. No.: 890,293

[22] Filed: Mar. 27, 1978

[51] Int. Cl.[2] ..... F15B 21/04

[52] U.S. Cl. ..... 93/1 E; 93/1 F; 93/1 G

[58] Field of Search ..... 93/1 E, 1 F, 1 G

[56] References Cited

U.S. PATENT DOCUMENTS

| | | | |
|---|---|---|---|
| 2,052,623 | 9/1936 | Harby | 93/1 E |
| 2,138,788 | 11/1938 | Hart et al. | 93/1 E |
| 3,865,017 | 2/1975 | Borski | 93/1 E |
| 3,978,191 | 8/1976 | Allen et al. | 93/1 E X |

*Primary Examiner*—Harrison L. Hinson

*Attorney, Agent, or Firm*—Hill, Van Santen, Steadman, Chiara & Simpson

[57] ABSTRACT

A method and apparatus for forming reinforced top file folders wherein a paperboard web is first sent through a cutting and scoring station where the web is severed transversely and the various score lines are formed therein, including one which is a relatively short distance behind the leading edge of the portion thus severed. In a subsequent station, an adhesive is applied in the form of a stripe immediately behind the score line. A hold down means is provided beyond the stage of adhesive application and is positioned such as to be received against the score line. A turnover means is positioned beyond the hold down means for folding the tab portion upwardly while the score line is received against the hold down means. A substantially right angle bend is thereby achieved between the forward marginal or tab portion and the score line with the adhesive behind it. The web is then severed in this condition by the cutting station and the adhesive coated and partly folded web is then pushed through the remainder of the turnover means and finally passes through a pressure means beyond the turnover means to complete the folding of the adhesived portion against the remainder of the web, thereby providing a double thickness at the leading edge of the web.

7 Claims, 8 Drawing Figures

METHOD AND APPARATUS FOR FORMING REINFORCED TOP FILE FOLDERS

BACKGROUND OF THE INVENTION

1. Field of the Invention

This invention is in the field of a method and apparatus for forming reinforced top file folders or double top file folders as they are known utilizing an improved hold down means and turnover means whereby the marginal or tab portion of the web can be initially folded at substantially right angles to the remainder of the web, and then the folding is completed by passing the thus partially folded web between a pair of inclined plates in the turnover means to complete the folding and deliver the folded web to the final compression means.

2. Description of the Prior Art

There have been other machines proposed for mechanically applying an adhesive near the die cut leading edge of a web of paperboard to provide a double thickness at the edge, and thereby reinforce the leading edge. These previously proposed systems, however, were quite cumbersome utilizing relatively large and expensive web turnover devices.

SUMMARY OF THE INVENTION

The present invention provides a hold down and turnover device for the manufacture of reinforced top file folders which is relatively simple and employs less mechanical movement while still providing an improved positive action so that the reinforced top file folders can be produced more reliably at increased speeds.

In the improved device of the present invention, a paperboard web of suitable width is suitably driven through a scoring and cutting station, an adhesive applicator station, and then to a hold down device which is arranged and proportioned to fit into a score line on the web which has been provided in a previous operation. The function of the adhesive applicator station is to lay down a stripe of adhesive immediately behind the aforementioned score line. As the leading forward edge of the web comes into the hold down device, the turnover means is actuated such that the tab portion extending between the extreme marginal forward edge of the web and the score line is folded upwardly at substantially an angle of 90° to the remainder of the web. Concurrently with this action, the cutting means and scoring means are operated to sever the blank of a single file folder from the continuous web. A second drive means then takes over the propulsion of the web through the remainder of the assembly, namely, through the turnover means which further folds the tab portion back against the adhesive strip, and finally the drive means direct the now folded forward edge portion of the severed web through a pressure means such as a pair of compression rollers to consolidate and firmly secure the folded over tab portion against the adhesive surface of the web.

DESCRIPTION OF THE PREFERRED EMBODIMENTS

Figure 1:
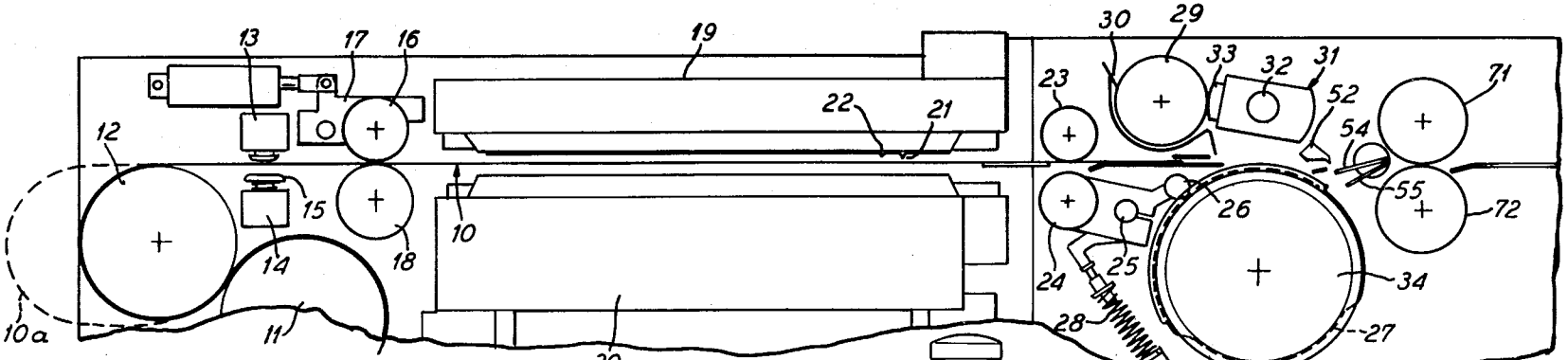
FIG. 1 is a fragmentary view in elevation which illustrates somewhat schematically the overall method and apparatus involved in the present invention.

In FIG. 1 reference numeral 10 has been applied generally to a web of paperboard of suitable weight and width to form the reinforced top file folder. The web 10 is delivered from a suitable source of supply between a metering roll 11 and a nip roll 12. After the web is trained around the surface of the nip roll 12, it passes between a pair of brake elements including an adjustable upper brake bar 13 and a lower brake bar 14 from which there extends a spring biased brake shoe 15. The web 10 then passes between a pair of drive rolls consisting of an upper feed roll 16 which is mounted on a support carriage 17 so as to be raisable and lowerable into engagement with the web, and a lower feed roll 18. Both upper roll 16 and lower roll 18 are positively driven from the same drive source.

The web then passes into a cutting and scoring assembly consisting of a fixed upper platen 19 and a lower reciprocating platen 20. A cutting edge 21 and a score former 22 are formed in the upper platen 19.

The web then passes between a pair of rolls such as a nip roll 23 and a cooperating drive roll 24 both of which are suitably geared together so as to positively drive the web 10 when the rolls 23 and 24 engage the web. The lower drive roll 24 is pivotally mounted by means of a shaft 25 whose position is determined by a cam follower 26 which rides on the surface of a cam 27. A spring 28 urges the cam follower 26 against the cam 27 and urges the lower drive roll 24 toward the web. As long as the cam follower 26 is on a high point of the cam 27, the drive roll 24 is biased out of engagement with the web. When, however, the cam rotates to where the cam follower 26 engages a low point, the drive roll 24 is biased into driving relation with the web 10 as will be explained in a succeeding portion of this description.

A glue wheel 29 is rotatably mounted with its periphery positioned to pick up glue or other adhesive from an adhesive trough 30. The glue roll 29 in turn applies adhesive to an applicator 31 which is mounted for rotation on a shaft 32. The actual applicator surface consists of a strip 33 composed of a relatively porous material such as a silicone rubber which picks up the adhesive from the surface of the glue wheel 29 and lays it down as a stripe on the underlying web. Beneath the glue applicator assembly is an impression roll 34 about one half of whose periphery there is a resilient coating such as a rubber blanket 35 (see FIG. 2). During each cycle of revolution of the applicator 31, therefore, the adhesive laden surface on the strip 33 lays down a strip of adhesive immediately behind the score line which, in a previous cycle was applied to the web by the score former 22.

Figure 2:
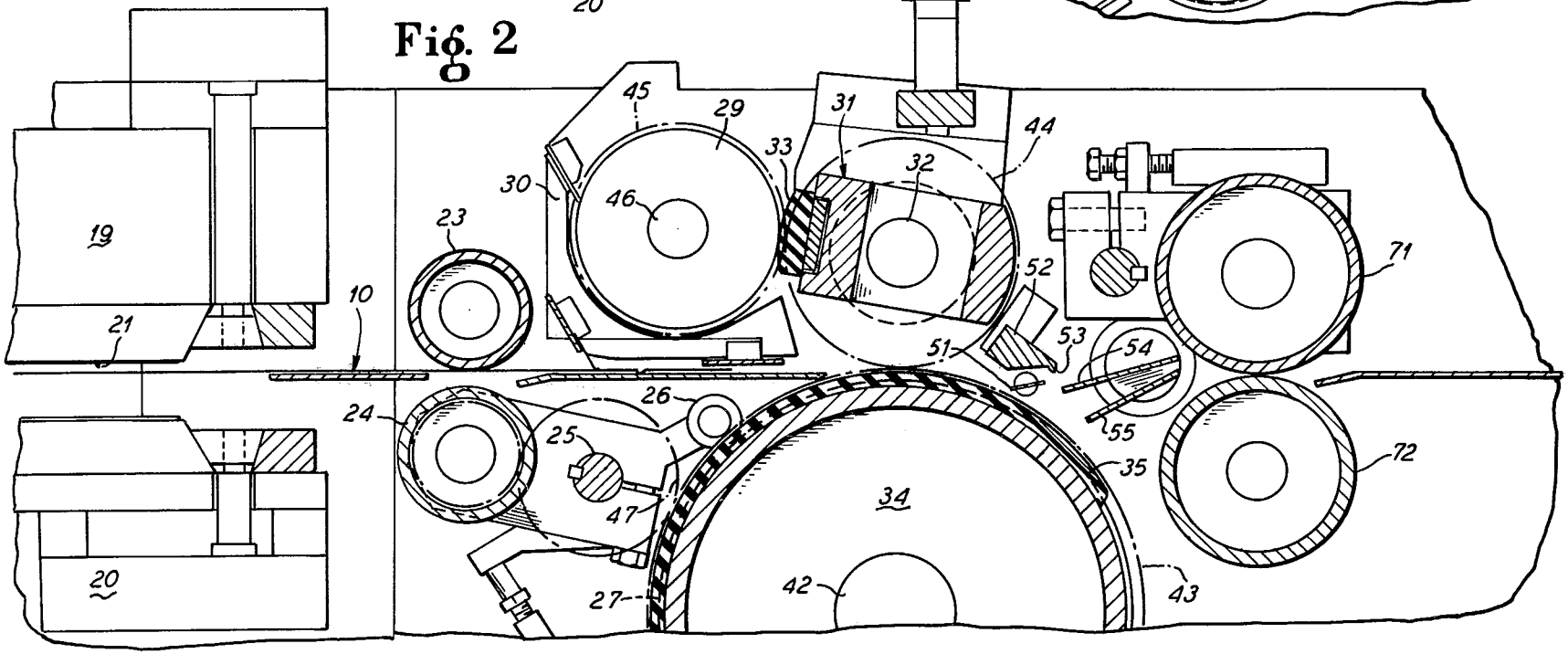
FIG. 2 is a fragmentary view partially in elevation, partially in cross section illustrating the adhesive applicator station and the turnover means which form portions of the present invention.
Figure 3:
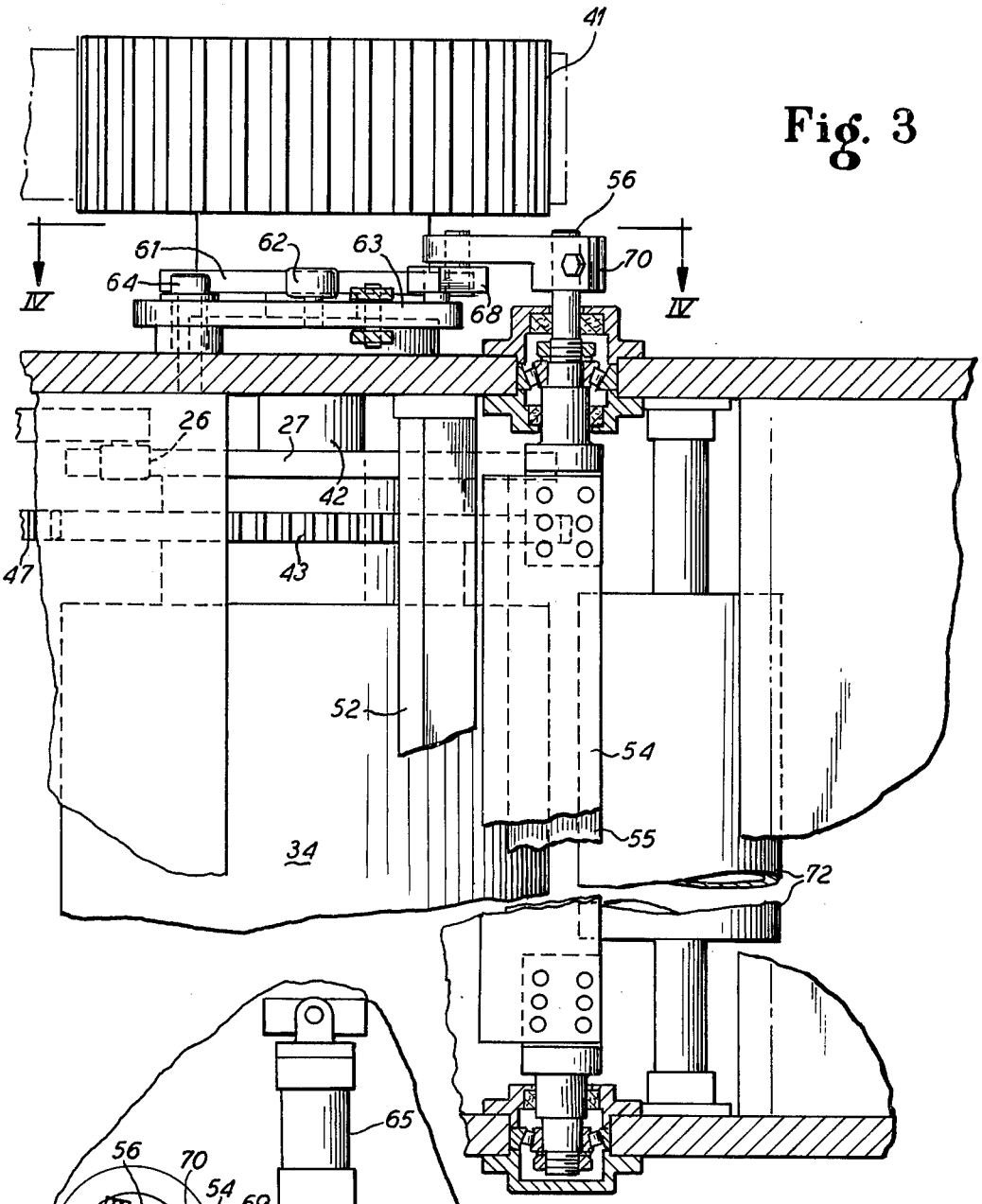
FIG. 3 is a plan view of a portion of the apparatus of the present invention.

The driving connection between the various rolls is illustrated in FIGS. 2 and 3. Specifically, there is provided a timing belt 41 which is driven from a suitable drive means (not shown). The timing belt is trained around a pulley which is secured to a common shaft 42. The shaft 42 also carries a gear 43 which meshes with a gear 44 on the shaft 32 carrying the applicator 31. The gear 44 in turn meshes with a gear 45 on a shaft 46 to which the glue wheel 29 is secured.

A reach gear 47 also meshes with the gear 43 and serves to drive the lower drive roll 24.

Once the glue stripe has been applied to the web 10, it passes over an adjustable deflector plate 51 the purpose of which is to prevent the adhesive covered web from following the contour of the periphery of the impression roll 34. The deflector plate 51 guides the web into contact with a stationary hold down device 52 having a depending finger type portion 53. The latter is arranged to be seated in a score line which has been formed in the web by the score former 22 in the previous cycle.

Figure 4:
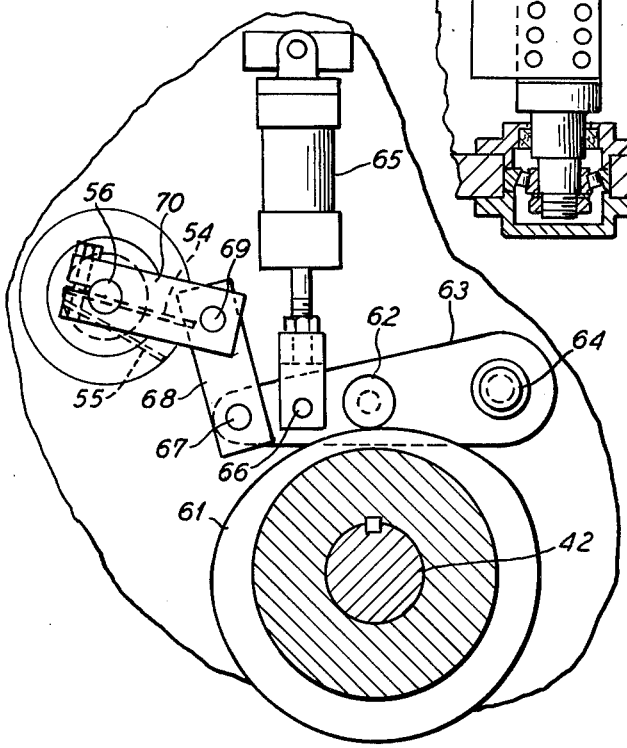
FIG. 4 is a view taken substantially along the line IV—IV of FIG. 3.

A turnover device beyond the hold down means 52 includes a pair of spaced plates 54 and 55 which are mounted for pivotal movement along a shaft 56 as seen in FIG. 4. The upper plate 54 is positioned to fold over the tab or marginal portion extending between the forward leading edge of the web and the score line immediately behind it. Pivotal movement of the plates is controlled by means of the assembly shown in FIG. 4. As shown in that FIG., there is provided a cam 61 on the shaft 42 on which the impression roll 34 is received. A cam follower 62 is supported on a link 63, which link is pivoted by means of a pin 64. The follower 62 is constantly urged into contact with the periphery of the cam 61 by means of an air cylinder 65 which is connected to a pin 66 passing through the link 63. At the opposite end of the link 63 there is a pin 67 to which there is connected a link 68. The latter in turn is connected by means of a pivot pin 69 to a link 70 which is rigidly connected to the pivot 56 about which the plates 54 and 55 move.

Figure 6:
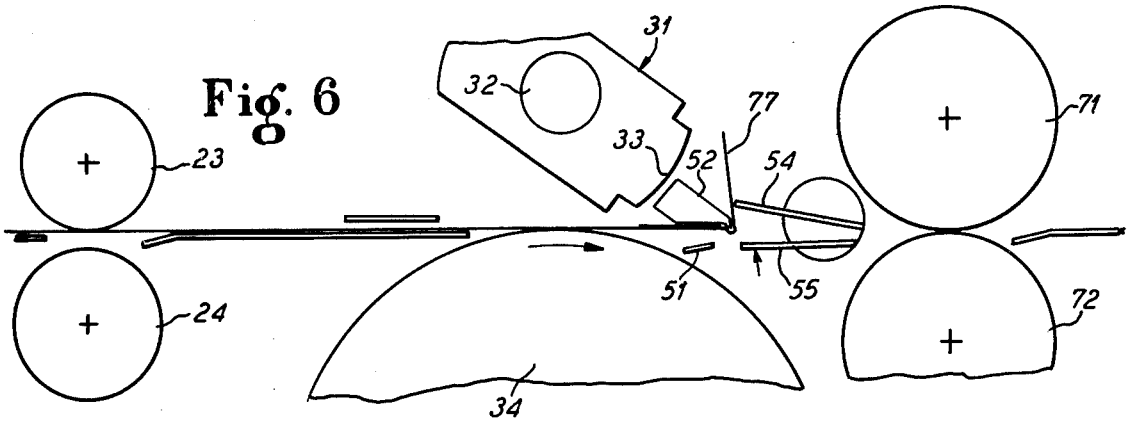
FIG. 6 is another schematic view illustrating the manner in which the hold down means and the turnover means cooperate to fold the tab or marginal portion of the web upwardly.
Figure 7:
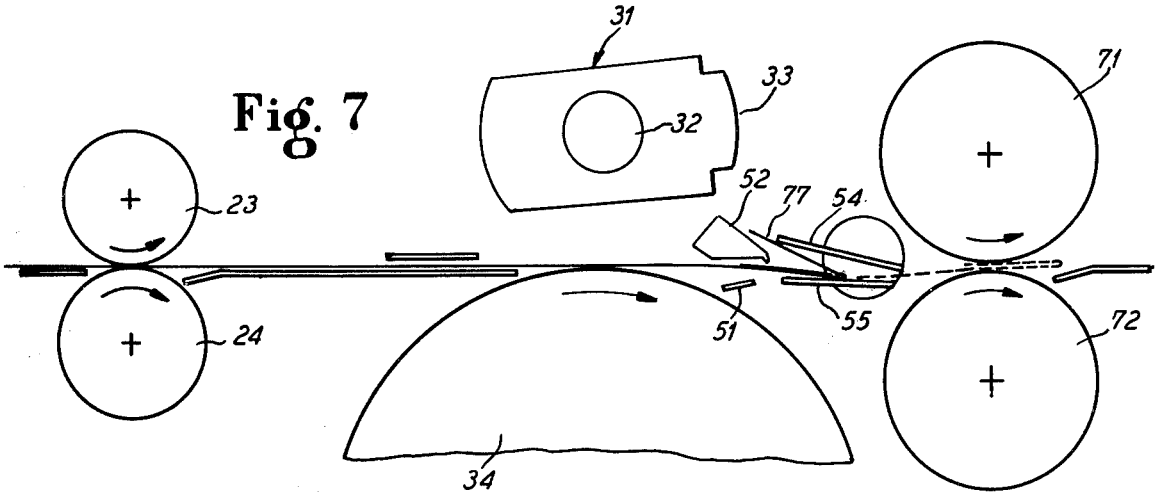
FIG. 7 is a view similar to FIG. 6 but illustrating the manner in which the now folded marginal portion is passed through the turnover means and ultimately into the pressure means for final consolidation.

When the cam 61 is rotated to the position where its high point engages the follower 62, the plates 54 and 55 are pivoted upwardly from the position shown in FIG. 2 to that shown in FIGS. 6 and 7. In this position, the partly folded web can be passed between the plates 54 and 55 as shown in FIG. 7. The acute angle between the spaced plates 54 and 55 finishes the folding operation and then the web is passed between a pair of combining rolls 71 and 72 where final consolidation of the double thickness at the leading edge of the web takes place.

Figure 5:
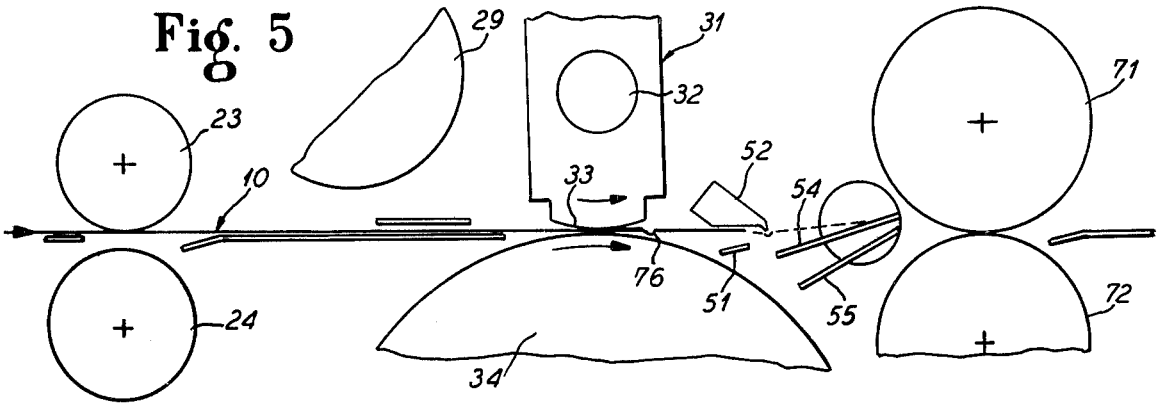
FIG. 5 is a somewhat schematic illustration showing the manner in which the adhesive is applied to the surface of the traveling web.

The sequential operation of the various elements during the operation of the apparatus is best illustrated in the rather schematic views of FIG. 5 to 7 inclusive. In FIG. 5, the web 10 is still being driven by the feed rolls 16 and 18. The showing in FIG. 5 is at the moment at which the applicator 31 applies the adhesive to the traveling web 10 while the web is in contact with the impression roll 34. As illustrated in FIG. 5, a stripe of adhesive is applied directly behind a score line 76 previously formed in the web. The web continues to move until the score line 76 is engaged by the hold down means 52. As this occurs the brake bar 15 is energized thereby stopping further feeding of the web through the assembly. At this time, the cam 61 is rotated sufficiently so that a high point on the cam rides against the follower 62, thereby causing the plates 54 and 55 to be pivoted as shown in FIG. 6, with the upper plate 54 folding the marginal end portion or tab portion 77 upwardly into a substantial right angle bend as shown in FIG. 6. The metering roll 11 and the nip roll 12 continue to rotate, however, so that the web builds up into a loop **10*a* behind the nip roll 12 as illustrated in FIG. 1. At the same time, the upper feed roll 16 is disengaged from contact with the web. Immediately thereafter, the die lower platen 20 is moved upwardly so that the cutting edge 21 and the score former 22** engage the web and sever the web across its entire width. It should be recognized that additional score lines may be also formed at this time, such as the transverse score lines and the center fold score lines but formation of such additional score lines is not important for the purposes of the present invention.

As this occurs, the cam follower 26 now rides on a low point on its cam, thereby moving lower drive roll 24 into driving engagement with the web. This condition is illustrated in FIG. 7 of the drawings. As also illustrated in that FIG., the partially folded tab portion 77 is further folded by being forced between the two plates 54 and 55 which are at an acute angle to each other. By the time the severed folder blank leaves the space between the plates 54 and 55, the tab 77 has been folded against the adhesive strip which has previously been applied to the web behind the score line 76. Further consolidation is then effected by the pressure at the nip between the combining rolls 71 and 72.

Figure 8:
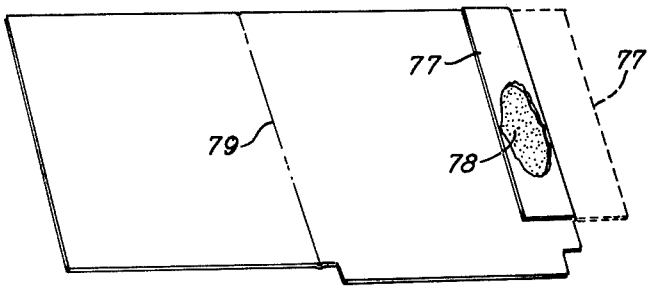
FIG. 8 is a view in perspective, partially broken away, of the finished file folder of the present invention.

FIG. 8 illustrates one form of file folder which can be produced according to the present invention. That FIG. illustrates a tab portion 77 being folded over at the leading end and provides a double thickness at that end by virtue of the deposit of adhesive 78 previously applied to the web. One or more additional score lines 79 can be also formed in the file folder depending upon the particular design employed.

It should be evident that various modifications can be made to the described embodiments without departing from the scope of the present invention.

I claim as my invention:

1. An apparatus for forming reinforced top file folders which comprises:

means for feeding a paperboard web to a cutting and scoring station, means at said cutting and scoring station for severing the web transversely and also for forming a score line a relatively short distance behind the leading edge of the portion thus severed, thereby defining a tab portion, applicator means for applying an adhesive to a portion of the web immediately behind said score line, hold down means beyond said applicator means having a portion arranged to be seated in said score line, turnover means positioned beyond said hold down means for folding the tab portion at right angles to said web while said score line is seated in said hold down means, and pressure means beyond said turnover means positioned to fold the tab portion while at right angles to said web against the adhesive striped web to thereby produce a double thickness at the leading edge of said web.

2. An apparatus according to claim 1 in which:

said turnover means includes a pair of spaced angularly disposed plates, the upper plate being positioned to fold said tab portion against said web, and means for rotating said plates to enable the partly folded web to be passed through the space between said plates.

3. An apparatus according to claim 1 in which said hold down means includes a depending finger portion arranged to be positioned in said score line.

4. An apparatus according to claim 2 in which said plates are positioned at an acute angle with respect to each other so that in passing through the space between the plates, the tab portion is folded back against the web prior to passage through said pressure means.

5. An apparatus according to claim 1 which includes:

first drive means for feeding the web into said cutting and scoring station, brake means acting on said web to stop travel of the portions of the web being scored and cut, and second drive means engageable with the severed web after application of the adhesive thereto to direct the severed web through said turnover means.

6. In an apparatus for forming a double top tab file folder in which a paperboard web is successively passed to a cutting and scoring station, an adhesive applicator station where a stripe of adhesive is applied immediately behind said score line, and a pressure station wherein the marginal portion is pressed against the adhesive coated portion of the severed web, the improvement which comprises:

a stationary hold down means between said adhesive applicator station and said pressure station, said hold down means including a portion which is proportioned to be received along a score line of said web, and a pivotable turnover means comprising two plates in spaced relation, the upper plate being positioned such that upon pivotal movement of said turnover means, said upper plate folds the marginal portion upwardly while said hold down means engages said score line.

7. An apparatus according to claim 6 in which:

said two plates are positioned in spaced relation at an acute angle whereby the passage of the partly folded web through the space between the plates completes the folding of the marginal portion against the adhesived top portion of the severed web.

* * * * *